US007793725B2

(12) United States Patent
Daniel et al.

(10) Patent No.: US 7,793,725 B2
(45) Date of Patent: Sep. 14, 2010

(54) METHOD FOR PREVENTING OVERPRESSURE

(75) Inventors: Jeremiah Daniel, Houston, TX (US); Jin-Sug Chung, Katy, TX (US); Ramanathan Ramaswamy, Katy, TX (US); Joseph M. Gebara, Houston, TX (US); John L. Upchurch, Sugar Land, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 110 days.

(21) Appl. No.: 11/567,663

(22) Filed: Dec. 6, 2006

(65) Prior Publication Data

US 2008/0135258 A1 Jun. 12, 2008

(51) Int. Cl.
*E21B 43/01* (2006.01)

(52) U.S. Cl. ..... 166/366; 166/352; 166/356; 166/345; 166/350; 405/224.2; 405/169; 441/3; 441/4; 441/5

(58) Field of Classification Search ..... 166/366–369, 166/359, 350, 351, 352; 405/224.2–224.4
See application file for complete search history.

(56) References Cited

U.S. PATENT DOCUMENTS 3,602,302 A 8/1971 Kluth
3,855,656 A 12/1974 Blenkarn
3,874,415 A 4/1975 Pierce et al.
4,436,048 A * 3/1984 Gentry et al. ..... 114/230.12
4,448,568 A * 5/1984 Gentry et al. ..... 405/168.3
4,478,586 A 10/1984 Gentry et al.
4,502,551 A * 3/1985 Rule et al. ..... 175/6
4,523,602 A 6/1985 Snyder
4,765,378 A * 8/1988 Engelskirchen et al. ..... 141/69
5,041,038 A 8/1991 Poldervaart et al.
5,275,510 A 1/1994 De Baan et al.
5,335,730 A * 8/1994 Cotham, III ..... 166/374
5,456,622 A 10/1995 Breivik et al.
5,515,803 A 5/1996 Korsgaard
5,697,732 A * 12/1997 Sigmundstad ..... 405/169
5,878,814 A * 3/1999 Breivik et al. ..... 166/267
5,895,077 A * 4/1999 Sigmundstad ..... 285/96
5,983,931 A * 11/1999 Ingebrigtsen et al. ..... 137/580
6,003,603 A * 12/1999 Breivik et al. ..... 166/357

(Continued)

*Primary Examiner*—Thomas A Beach
*Assistant Examiner*—Matthew R Buck
(74) *Attorney, Agent, or Firm*—Merchant & Gould

(57) ABSTRACT

The present invention relates to overpressure protection systems and methods for use on a production system for transferring hydrocarbons from a well on the seafloor to a vessel floating on the surface of the sea. The production system includes a subsea well in fluid communication with a turret buoy through a production flowline and riser system. The turret buoy is capable of connecting to a swivel located on a floating vessel. The overpressure protection device is positioned upstream of the swivel, to prevent overpressure of the production swivel and downstream components located on the floating vessel. The device may include one or more shut down valves, one or more sensors, an actuator assembly, and a control processor. Each shut down valve and sensor is coupled to a production flowline. Each of the sensors is capable of generating a signal based upon a pressure sensed within the production flowline. The actuator assembly is connected to each of the shut down valves for operating the shut down valves. The control processor, which may be a programmable logic controller, receives a signal from the sensors and sends a valve control signal to the actuator assembly for operating the shut down valves in response to the received signals.

11 Claims, 4 Drawing Sheets

U.S. PATENT DOCUMENTS 6,021,848 A 2/2000 Breivik et al.
6,050,747 A * 4/2000 Midttveit ..... 405/224.2
6,053,787 A * 4/2000 Erstad et al. ..... 441/5
6,059,620 A * 5/2000 Yetman ..... 441/4
6,094,937 A * 8/2000 Paurola et al. ..... 62/613
6,193,574 B1 * 2/2001 Pollack ..... 441/4
6,199,500 B1 3/2001 Borseth et al.
6,220,787 B1 * 4/2001 Tanabe et al. ..... 405/169
6,230,809 B1 * 5/2001 Korsgaard ..... 166/352
6,257,801 B1 7/2001 Kelm et al.
6,772,840 B2 8/2004 Headworth
6,811,355 B2 * 11/2004 Poldervaart ..... 405/169
6,845,727 B2 * 1/2005 Eide et al. ..... 114/230.12
6,926,084 B2 * 8/2005 Erstad ..... 166/345
6,968,899 B1 * 11/2005 Poldervaart et al. ..... 166/355
7,073,593 B2 7/2006 Hatton et al.
7,093,661 B2 8/2006 Olsen
7,434,624 B2 10/2008 Wilson
2003/0056954 A1 3/2003 Headworth
2003/0099517 A1 * 5/2003 Poldervaart ..... 405/224.2
2003/0138299 A1 * 7/2003 Eide et al. ..... 405/224.2
2004/0042856 A1 * 3/2004 Erstad ..... 405/224.2
2004/0076478 A1 4/2004 Legras et al.
2004/0144543 A1 7/2004 Appleford et al.
2005/0145388 A1 7/2005 Hopper
2006/0243328 A1 * 11/2006 Bessmertny ..... 137/487.5
2007/0095427 A1 * 5/2007 Ehrhardt et al. ..... 141/387
2007/0155259 A1 * 7/2007 Van Tol et al. ..... 441/3
2008/0135256 A1 6/2008 Daniel
2008/0138159 A1 6/2008 Daniel
2008/0140337 A1 6/2008 Daniel

* cited by examiner

METHOD FOR PREVENTING OVERPRESSURE

TECHNICAL FIELD

The present invention relates generally to methods and systems for transferring produced hydrocarbons from a subsea well to a floating vessel, and more particularly, to prevent over pressuring of a production swivel, and the downstream equipment.

BACKGROUND OF THE INVENTION

In the production of hydrocarbons from marine oil and gas deposits, a fluid communication system from the sea floor to the surface is required. Such a system usually includes multiple conduits through which various fluids flow between a subsea well or pipeline to a surface facility. The multiple conduits for communicating with a surface facility typically include subsea trees, manifolds, production and export flowlines, buoys and riser systems.

One method for producing hydrocarbons from marine oil fields is to use a fixed facility attached to the seafloor, however; fixed facilities can be enormously expensive. A lower cost approach for producing from marine oil fields involves the use of floating facilities or floating vessels. Floating vessels present additional challenges as they can undergo a variety of movements in an offshore environment and are exposed to rapidly changing and unpredictable surface and sub-surface conditions. In particularly extreme weather conditions, it may be necessary for the floating vessel to disconnect from its associated production flowline and riser system.

Common industry practice is to accommodate vessel rotation about a riser system by means of a turret and swivel assembly, which may be internal or external to the floating vessel. The riser system is designed to terminate in a turret buoy, which is designed to interface with a rotatable swivel located on the floating vessel. Such marine riser systems include Submerged Turret Production (STP), and Submerged Turret Loading (STL) to transfer the produced hydrocarbons under high pressure to a production plant or storage unit on a floating vessel. Unfortunately, commercially available and operating production swivels are limited to design pressures of less than 5,000 psig, while well head shut in pressure is capable of reaching over 10,000 psig at the surface.

Given a high reservoir pressure, overpressure of the production swivel and the downstream components poses a substantial risk. Therefore there is a need for a pressure protection system that can be used in conjunction with a swivel and turret buoy to achieve offshore production of hydrocarbons without exceeding the pressure limitation of the production swivel. The aim of the present invention is to provide an alternative in which the above mentioned problems are overcome or in the very least alleviated.

The invention in its preferred embodiments provides an overpressure protection system incorporated in the turret buoy to prevent overpressure of the production swivel and the downstream components. Additionally, locating the pressure protection system in the turret buoy offers easy access, and inexpensive installation, operation and maintenance compared to subsurface locations.

SUMMARY OF THE INVENTION

The present invention relates to method for preventing overpressure of the production swivel and downstream components while producing hydrocarbons form a subsea well.

The some embodiments, the present invention is directed to methods for producing hydrocarbons from a subsea well, including the steps of connecting a turret buoy to a swivel having a pressure rating, the turret buoy having a production flowline connected to a subsea well, producing a flow of hydrocarbons from the subsea well, the flow of hydrocarbons having a hydrostatic pressure, sensing the pressure within the production flowline; and actuating a shut down valve on the production flowline within the turret buoy when the hydrostatic pressure of the flow of hydrocarbons in the production flowline is greater than the pressure rating of the swivel.

Optionally, in some embodiments of the present invention, the overpressure protection device includes a bypass system for use in restarting production, and the pressure can be sensed downstream of the swivel located on the floating vessel.

Additional features and advantages of the present invention are described in, and will be apparent from, the following Detailed Description of the Invention, Detailed Description of the Drawings and the Figures.

BRIEF DESCRIPTION OF THE DRAWINGS

These and other objects, features and advantages of the present invention will become better understood with regard to the following description, pending claims and accompanying drawings where:

Figure 1:
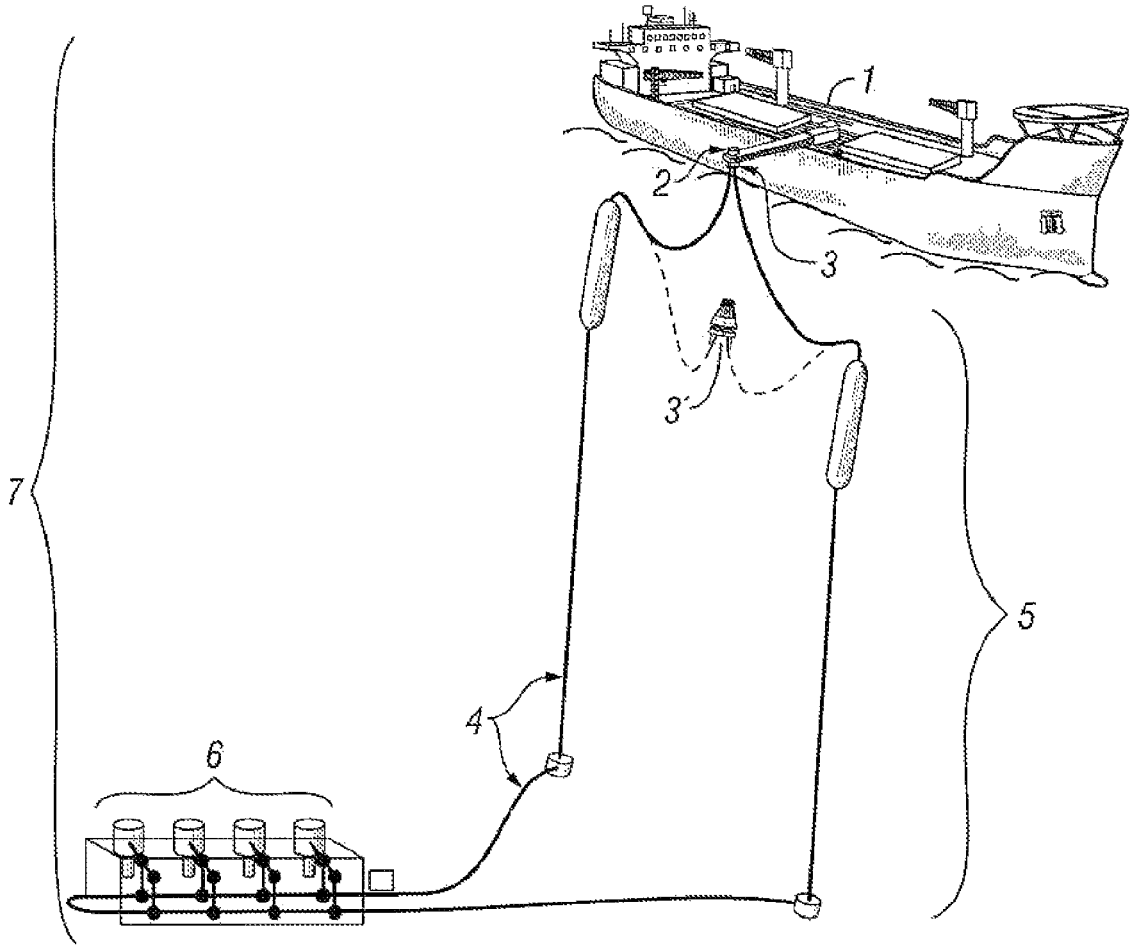
FIG. 1 is a schematic view of a production system for transferring fluid between a well on the seafloor and a vessel floating on the surface of the sea.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which are included within the spirit and scope of the invention, as defined by the appended claims.

DETAILED DESCRIPTION OF THE INVENTION

While this invention is susceptible of embodiments in many different forms, there are shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

Methods and systems for the interfacing between floating vessels and marine riser systems and overpressure protection systems have been described in the literature. However, no existing approach considers the idea, introduced here for the present invention, of using an overpressure protection device, located upstream of the production swivel, preferably within a turret buoy, to prevent overpressure of the swivel and other topside equipment. Overpressure is of particular concern because commercially available production swivels have pressure ratings substantially less than the shut-in pressures of some subsea wells. Well head shut-in pressure for design purposes is typically 10,000 psig at the surface. Common practice is to have all production flowlines, risers and other equipment rated to the well head shut-in pressure, however, swivels within this rating are not available in the industry. Commercially available production swivels are generally limited to operational pressures of less than 5,000 psig.

The overpressure protection device of the present invention overcomes such problems by providing a means for preventing overpressure in a production system. The production system for transferring hydrocarbons includes a subsea well in fluid communication with floating vessel through a production swivel, turret buoy, production flowline and riser system. There are a number of existing production systems suitable for use in the present invention, such as those illustrated in FIG. 1 and FIG. 2.

The term "downstream," as defined herein, refers to the flow of hydrocarbons in the direction of the equipment, facilities or systems for refining crude oil into petroleum products and the distribution, marketing, and shipping of the products. Conversely, "upstream," as defined herein, refers to equipment, facilities or systems located towards the producing reservoir.

The term "production flowline" or "flowline," as defined herein, is intended to refer to internal and external flowlines and piping such as within the turret buoy and external to the turret buoy.

The floating vessel can be any floating facility that can receive, process, store or export produced hydrocarbons, and is capable of connecting to a production flowline and riser system at a disconnectable buoy. Typical floating facilities or vessels that can be used include, but are not limited to: floating production storage and offloading (FPSO) vessels, barges, articulated tug barges, semi-submersible rigs, and ships.

A production swivel can be located on an external structure on the floating vessel, or can be located internally in an open receiving space on the floating vessel. The swivel forms the interface between the topsides and risers and subsea facilities, and permits rotation of the floating vessel about the risers while transferring produced hydrocarbons from a subsea well. The connection and disconnection system controls and hardware are located in the turret with the corresponding equipment located on a turret buoy. Such systems or methods include, but are not limited to Quick Connect and Disconnect (QC/DC) systems, turrets, wedges, clamps, and collet connectors. The buoy is typically pulled into and secured in a mating cone within the swivel. The swivel stack provides an uninterrupted path for injection fluids, hydraulic power and high voltage electrical power supplies for the buoy and subsea components or facilities, in addition to connections for the production flowlines.

Figure 3:
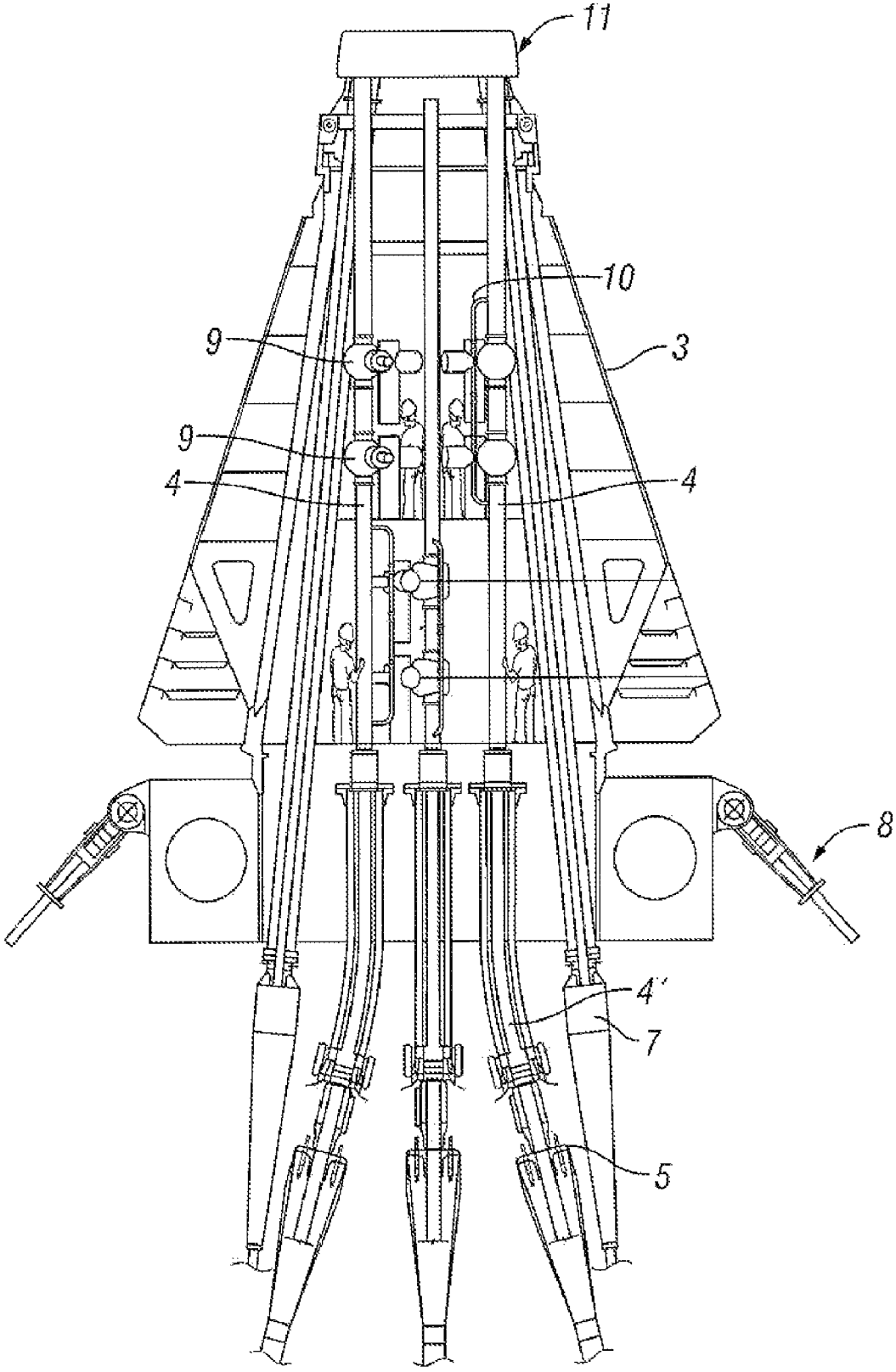
FIG. 3 is a schematic view of a turret buoy suitable for use in the present invention.

The turret buoy is the connection point between the marine risers and the piping upstream of the swivel on the floating vessel. While a variety of riser termination buoys may be employed and are capable of housing connection and disconnection system controls and hardware for connecting to the swivel on a floating vessel, FIG. 3 illustrates the use of a turret buoy as the disconnectable buoy of the invention. There are a number of existing turret buoys and disconnectable turret systems suitable for use in the present invention, such as those manufactured by Advanced Production and Loading AS, FMC SOFEC, Single Buoy Mooring Inc, and as described in applicants' co-pending U.S. patent application to Jeremiah Daniel, et al., titled Marine Riser System, Ser. No. 11/567,649, filed concurrently herewith on Dec. 6, 2006, which is incorporated by reference herein.

Typical turret buoys have piping or production flowlines that extend through a vertical shaft within the buoy for connection to the swivel at the top of the buoy and to the riser system at the bottom of the buoy. When the disconnectable buoy is a turret buoy, the risers are connected to the piping that extends below the buoy with bolts or other conventional connecting means may be used. The lower portion of the buoy is in fluid communication with a subsea well through at least one riser and its associated production flowline.

The marine riser system provides the means for fluid communication between the buoy and at least one production flowline on the sea floor, which is connected to at least one subsea well. The risers may be steel catenary risers or flexible risers with single or multiple flow lines, depending on the characteristics of the production system.

When disconnected the turret buoy is stowed at a depth of water which is below all seagoing traffic. The floating vessel will locate the turret buoy by means known in the art, such as a positioning system transponder or floatation marker on the surface of the sea. The turret buoy is brought up and connected to a rotatable swivel located on the floating vessel such that the vessel can freely weathervane about the buoy according to the wind and weather conditions. A flow of hydrocarbons is established between the subsea wells and the floating vessel through the risers, turret buoy and swivel.

Figure 4:
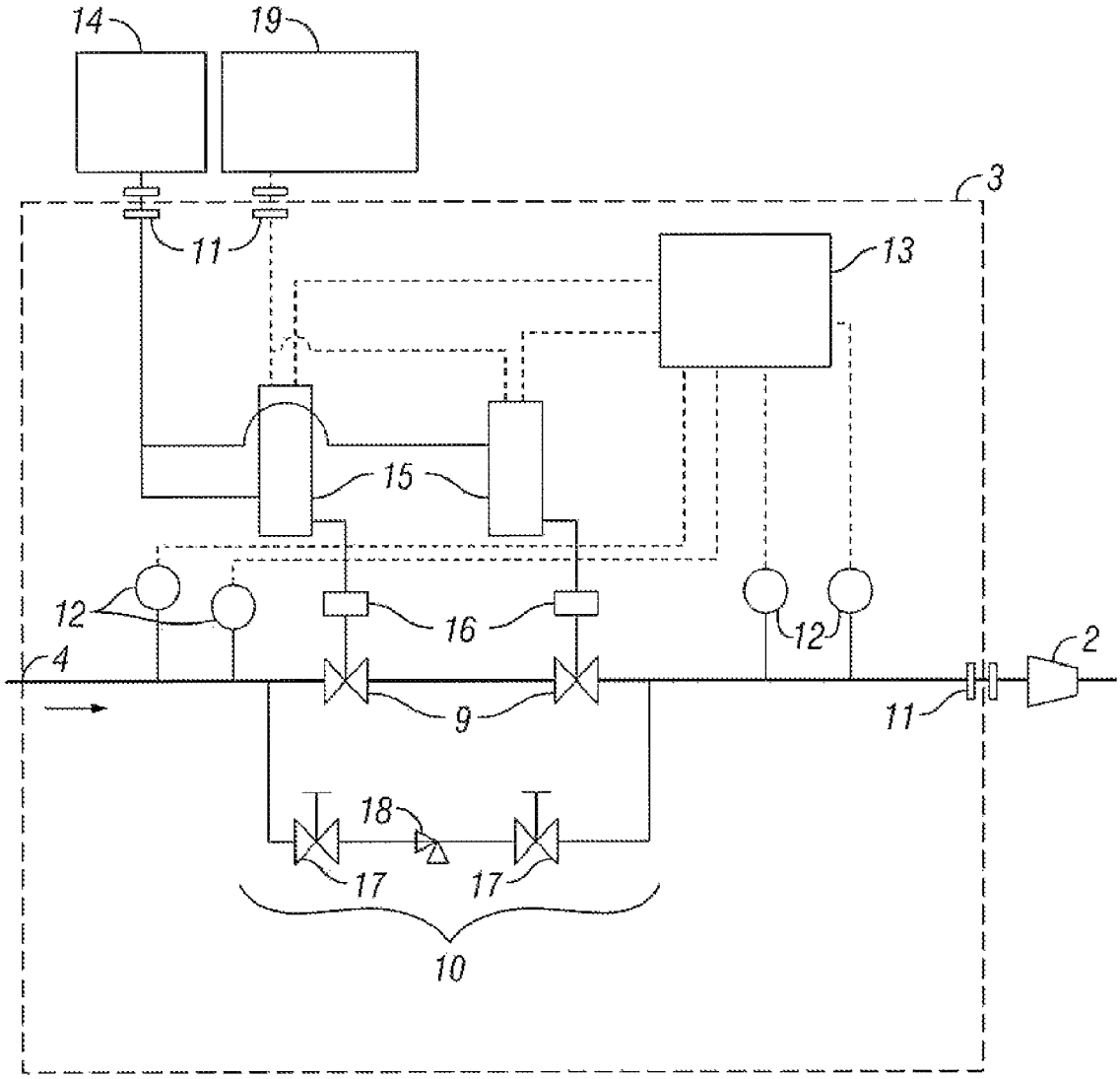
FIG. 4 is a schematic view of an embodiment of the present invention.

FIG. 4 illustrates an overpressure protection device of the present invention, which is for use on a production flowline within a turret buoy. The overpressure protection device includes: a shut down valve operatively coupled to a production flowline; a sensor operatively coupled to the production flowline for generating a signal based upon a pressure sensed within the production flowline; and a control processor for receiving the signal from the sensor and for operating the shut down valve in response to the signal.

An overpressure protection device suitable for use in the present invention is described in applicants' co-pending U.S. patent application to Jeremiah Daniel, et al., titled Overpressure Protection Device, Ser. No. 11/567,658, filed concurrently herewith on Dec. 6, 2006, which is incorporated by reference herein.

Figure 5:
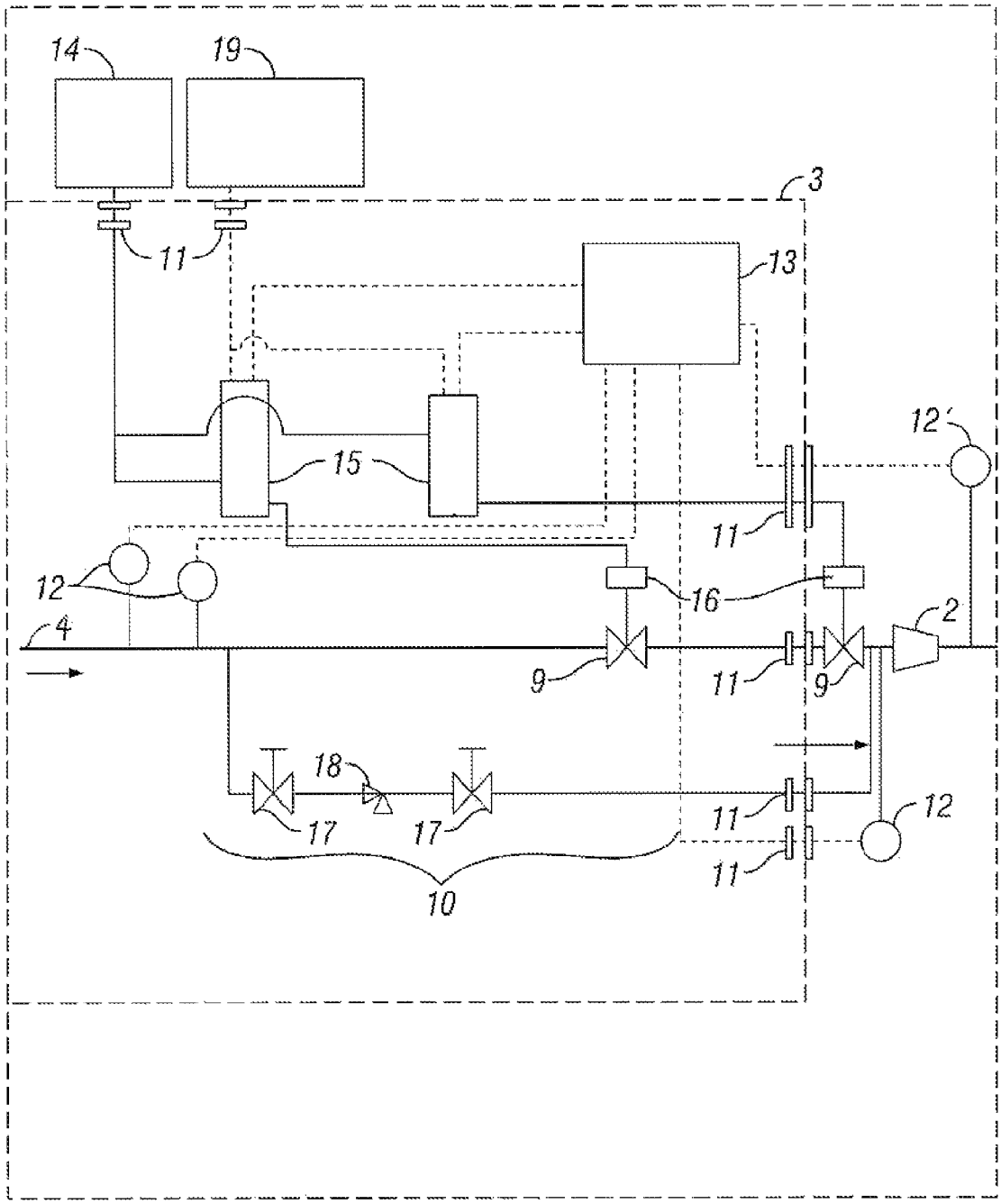
FIG. 5 is a schematic view of the components of an embodiment of the present invention.

One or more shut down valves are operatively coupled to a production flowline disposed within a turret buoy. There may be one or more production flowlines, each having at least one shut down valve and at least one sensor. The shut down valves are positioned upstream of the swivel. FIG. 5 shows one shut down valve downstream of the QC/DC and outside of turret buoy. In this embodiment the QC/DC shall have to withstand the full shut-in tubing pressure. The actuator assembly, including one or more of a hydraulic power unit (HPU), a directional control valve (DCV) and a solenoid valve, operates the shut down valves. The HPU provides hydraulic power at 3000 to 5000 psig to the DCV. The DCV operates the solenoid valves which provide hydraulic power to operate the shut down valves. The electrical power supply for the overpressure protection device and the HPU can be located on the floating vessel.

One or more sensors are operatively coupled to the production flowline for generating a signal based upon a pressure sensed within the production flowline. The sensors can be located upstream, downstream, or in between the shut down valves, and upstream or downstream of the turret buoy or swivel. The sensors provide a signal to the control processor. The control processor, which can be a programmable logic controller (PLC), compares the received signal with a stored pressure value and determines whether to send a valve control signal to the actuator assembly to provide the hydraulic power to operate the shut down valves. The stored pressure value can be the pressure rating for the swivel as designed by the manufacturer. When two or more signals are received by the PLC, the PLC utilizes voting logic to compare the received signals with the stored pressure value. When the PLC determines through the voting logic that the sensed pressure exceeds the stored value, the value control signal is sent to the actuator assembly to close the shutdown valves.

Another embodiment includes a method for preventing overpressure in a production flowline. The method includes the steps of: sensing the pressure within the production flowline and actuating a shut down valve on the production flowline in response to the sensed pressure. The step of sensing the pressure can be performed in a plurality of locations on the production flowline: within the turret buoy, upstream of the swivel, and downstream of the swivel. The sensors transmit a signal indicative of the pressure within the production flowline to the control processor. The control processor compares the signal with a stored pressure value and actuates the shut down valve when the signal exceeds the stored pressure value.

Another embodiment includes a method for producing hydrocarbons from a subsea well. The method includes the steps of: connecting a turret buoy to a swivel having a lower pressure rating. The pressure rating of the swivel is less than about 5,000 psig, in some cases less than about 4,000 psig, in other cases less than about 3,000 psig, and still in others less than about 2,000 psig. The turret buoy having a production flowline connected to a subsea well as described herein, for producing a flow of hydrocarbons from the subsea well, the flow of hydrocarbons having a flowing pressure. Sensing the hydrostatic pressure within the production flowline at a plurality of locations. The hydrostatic pressure will depend on a variety of factors including reservoir pressure and depth of the subsea well and can exceed 5,000 psig, and range up to at least 12,500 psig at the sea floor and 10,000 psig at the surface. Actuating a shut down valve on the production flowline within the turret buoy when the flowing pressure of the flow of hydrocarbons in the production flowline is greater than the pressure rating of the swivel.

A bypass system is provided around the shut down valves to restart production after the shut down valves have been closed to prevent overpressure downstream of the shut down valves. The bypass system includes a shut down valve and a choke, which are capable of being operated manually. The bypass line is opened to bleed down the pressure in the production flowline below the pressure rating of the swivel to facilitate opening of the shut down valves on the production flowline. After the pressure has been adjusted, the transfer of fluids, such as petroleum products, from a subsea well through the production flowlines and risers to loading tanks onboard the floating vessel, is resumed.

DETAILED DESCRIPTION OF THE DRAWINGS

The embodiment illustrated in FIG. 1, shows a production system for transferring fluid between a well on the seafloor and a vessel floating on the surface of the sea. The production system 7 includes a turret buoy 3 capable of connecting to a floating vessel 1. The upper part of the turret buoy 3 connects to the swivel 2 located on an external structure on the floating vessel 1. The swivel 2 permits rotation of the floating vessel about the risers 5, while transferring produced hydrocarbons from a subsea well 6 through a production flowline 4. The lower portion of the turret buoy 3 is connected to the risers 5. When disconnected from the floating vessel, the disconnectable buoy 3' is held between the risers 5.

Figure 2:
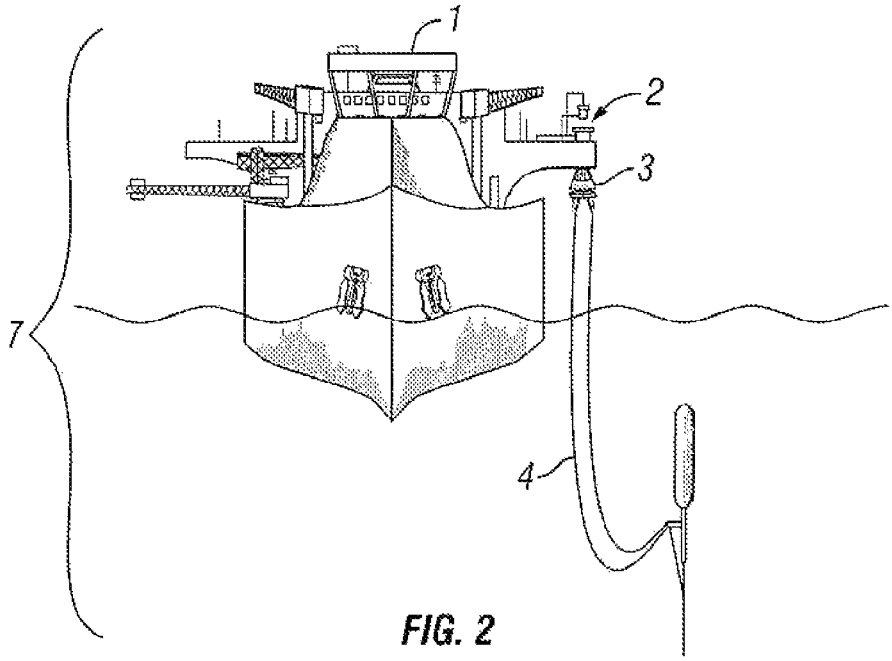
FIG. 2 is a schematic view of showing an alternate view of a production system for transferring fluid between a well on the seafloor and a vessel floating on the surface of the sea.

The embodiment illustrated in FIG. 2, shows an alternate view of a production system for transferring fluid between a well on the seafloor and a vessel floating on the surface of the sea. The production system 7 includes a disconnectable turret buoy 3 capable of connecting to a floating vessel 1. The turret buoy 3 connects to the swivel 2 located on an external structure on the floating vessel 1. The swivel 2 permits rotation of the floating vessel about the risers and production flowlines 4, while transferring produced hydrocarbons. The lower portion of the turret buoy 3 is connected to the production flowlines 4.

The embodiment illustrated in FIG. 3, shows an example of a turret buoy suitable for use in the present invention described herein. The turret buoy 3 includes Quick Connect and Disconnect (QC/DC) 11 for connecting and disconnecting from the swivel 2 on a floating vessel. The swivel is downstream of the turret buoy and is not shown. Umbilicals 7 are connected to the turret buoy for providing control of subsea components. Mooring lines 8 can be used to provide stability to the turret buoy. The risers 5 are connected to the production piping through the jumpers 4' that are partially positioned within the turret buoy 3. The shut down valves 9 and bypass system 10 are coupled to the production flowlines 4.

FIG. 4 is a schematic view of an embodiment of the present invention described herein. The outer boundary of the turret buoy 3 is indicated by a dashed line surrounding the components. Shut down valves 9 and sensors 12 are coupled to the production flowline 4. The turret buoy connects to the swivel 2 on the floating vessel using a QC/DC 11. The hydraulic power unit (HPU) 14 provides hydraulic power to the directional control valve (DCV) 15 which operates the solenoid valves 16. The solenoid valves 16 provide hydraulic power to operate the shut down valves 9. The electrical power supply 19 supplies power to the overpressure protection device. The HPU 14 and the electrical power supply 19 are located on the floating vessel. The sensors 12 provide a signal to the control processor 13. The control processor 13 compares the received signal with a stored pressure value and determines whether to send a valve control signal to the DCV 15 to operate the solenoid valves 16 and consequently the shut down valves 9. When two or more received signals exceed the stored pressure value the control processor 13 sends a valve control signal to actuator assembly, which includes the HPU 14, DCV 15 and solenoid valves 16, to close the shut down valves 9. For restart of production a bypass system 10, is provided around the shut down valves 9 to bleed down the pressure to facilitate opening the shut down valves 9. The bypass system 10 includes a shut down valve 17, and a choke 18.

In the embodiment illustrated in FIG. 5, the overpressure protection device has a shut down valve 9 and a solenoid valve 16 located downstream of the turret buoy and a sensor 12' located downstream of the swivel 2. The outer boundary of turret buoy 3 is indicated by a dashed line. Shut down valves 9 and sensors 12 and 12' are coupled to the production flowline 4. The turret buoy connects to the swivel 2 on the floating vessel using a QC/DC 11. The hydraulic power unit (HPU) 14 provides hydraulic power to the directional control valve (DCV) 15 which operates the solenoid valves 16. The solenoid valves 16 provide hydraulic power to operate the shut down valves 9. The electrical power supply 19 supplies power to the pressure protection device components. The HPU 14 and the electrical power supply 19 are located on the floating vessel. The sensors 12 and 12' provide a signal to the control processor 13. The control processor 13 compares the received signals with stored pressure values and determines whether to send a valve control signal to the DCV 15 to operate the solenoid valves 16 and consequently the shut down valves 9.

When two or more of the sensors 12 and 12' send signals that exceed the stored pressure value the control processor 13 sends a valve control signal to actuator assembly, which includes the HPU 14, DCV 15 and solenoid valves 16, to close the shut down valves 9. For restart of production a bypass system 10, is provided around the shut down valves 9 to bleed down the pressure to facilitate opening the shut down valves 9. The bypass system 10 includes a shut down valve 17, and a choke 18.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method of producing hydrocarbons from a subsea well, the method comprising:

a) locating a turret buoy held between a plurality of risers, wherein the risers are supported by riser buoys without aid of the turret buoy and the risers are positioned about the turret buoy so that the turret buoy is horizontally balanced between the riser buoys while disconnected from a floating vessel;

b) connecting the turret buoy to a swivel having a pressure rating, the turret buoy having a production flowline connected to a subsea well through the plurality of risers;

c) producing a flow of hydrocarbons from the subsea well, the flow of hydrocarbons having a hydrostatic pressure;

d) sensing the pressure within the production flowline; and e) actuating a shut down valve on the production flowline within the turret buoy when the hydrostatic pressure of the flow of hydrocarbons in the production flowline is greater than the pressure rating of the swivel.

2. The method of claim 1, wherein the pressure rating of the swivel is less than about 5,000 psig.

3. The method of claim 2, wherein the pressure rating of the swivel is less than about 4,000 psig.

4. The method of claim 3, wherein the pressure rating of the swivel is less than about 3,000 psig.

5. The method of claim 4, wherein the pressure rating of the swivel is less than about 2,000 psig.

6. The method of claim 1, wherein the pressure is sensed at a plurality of locations.

7. The method of claim 1 further comprising actuating a plurality of shut down valves in response to the sensed pressure.

8. The method of claim 2 further comprising the step of opening a bypass line to reduce the pressure in the production flowline.

9. The method of claim 3 wherein the step of sensing pressure includes generating a signal indicative of the pressure within the production flowline.

10. The method of claim 9 further includes the step of comparing the signal with a stored pressure value and actuating the shut down valve when the signal exceeds the stored pressure value.

11. The method of claim 10 wherein the step of comparing the signal with a stored pressure value is performed by a programmable logic controller.

* * * * *

UNITED STATES PATENT AND TRADEMARK OFFICE

CERTIFICATE OF CORRECTION

PATENT NO. : 7,793,725 B2
APPLICATION NO. : 11/567663
DATED : September 14, 2010
INVENTOR(S) : Jeremiah Daniel et al.

It is certified that error appears in the above-identified patent and that said Letters Patent is hereby corrected as shown below:

Title Page

Item (73) Assignee: "Chevron U.S.A. Inc., San Ramon, CA (US)"
should read --Chevron U.S.A. Inc., San Ramon, CA (US);
and Technip USA, Inc., Houston, TX (US)--

Signed and Sealed this
Twenty-second Day of February, 2011

David J. Kappos

David J. Kappos
*Director of the United States Patent and Trademark Office*